US005414499A

United States Patent [19]

Yahata

[11] Patent Number: 5,414,499

[45] Date of Patent: May 9, 1995

[54] DEVELOPING DEVICE FOR IMAGE FORMING APPARATUS HAVING IMPROVED AIR/TONER FILTERING

[75] Inventor: Masasumi Yahata, Yokohama, Japan

[73] Assignee: Ricoh Company, Ltd., Tokyo, Japan

[21] Appl. No.: 171,635

[22] Filed: Dec. 22, 1993

[30] Foreign Application Priority Data

Dec. 26, 1992 [JP] Japan ..... 4-359262

[51] Int. Cl.[6] ..... G03G 15/06

[52] U.S. Cl. ..... 355/260; 141/363; 222/325; 222/DIG. 1; 355/215

[58] Field of Search ..... 355/215, 260, 245; 222/DIG. 1, 325, 544; 141/363, 364

[56] References Cited

U.S. PATENT DOCUMENTS

| | | | |
|---|---|---|---|
| 4,583,112 | 4/1986 | Morano et al. | 355/215 |
| 5,012,289 | 4/1991 | Aldrich et al. | 355/260 |
| 5,221,945 | 6/1993 | Smith | 355/260 |

FOREIGN PATENT DOCUMENTS

| | | | |
|---|---|---|---|
| 4128101 | 2/1993 | Germany | 355/260 |
| 60-263972 | 12/1985 | Japan | 355/260 |
| 61-140968 | 6/1986 | Japan | 355/215 |
| 2-139587 | 5/1990 | Japan | 355/260 |
| 4-9982 | 1/1992 | Japan | 355/260 |

*Primary Examiner*—A. T. Grimley
*Assistant Examiner*—William J. Royer
*Attorney, Agent, or Firm*—Oblon, Spivak, McClelland, Maier & Neustadt

[57] ABSTRACT

A developing device for an image forming apparatus and operable with a developer cartridge mounted on, for example, the top of a hopper thereof. When the cartridge is inserted into a predetermined space defined in the device, it forms a clearance having a predetermined sectional area and extending in the direction of cartridge insertion in cooperation with a wall that delimits the space. Hence, air inside the space is forced out to the outside via the clearance which terminates at a cartridge inlet. A filter is affixed to the outer periphery of at least the leading end portion of the cartridge, with respect to the direction of cartridge insertion, in such a manner as to block the clearance. As a result, when air flows through the clearance, a toner entrained by the stream of air is caught by the filter. Also according to the invention, the cartridge includes a shutter which is movable back and forth to open or close a developer outlet of the cartridge, where the shutter cooperates with one or more openings formed integral with the cartridge and/or the hopper in order to provide communication between internal spaces of the hopper and the outside environment so as to reduce pressure buildup within the hopper.

12 Claims, 12 Drawing Sheets

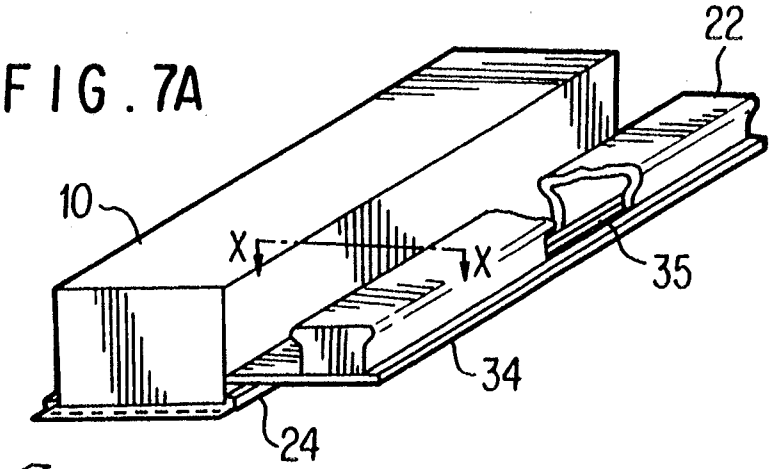
FIG. 7A
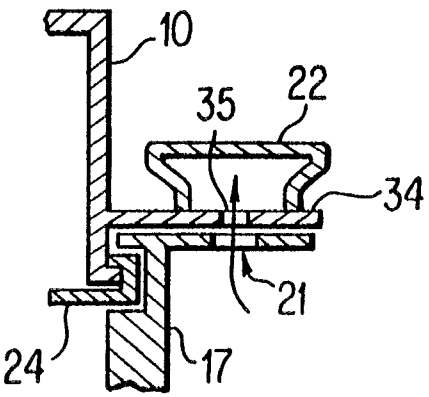
FIG. 7B
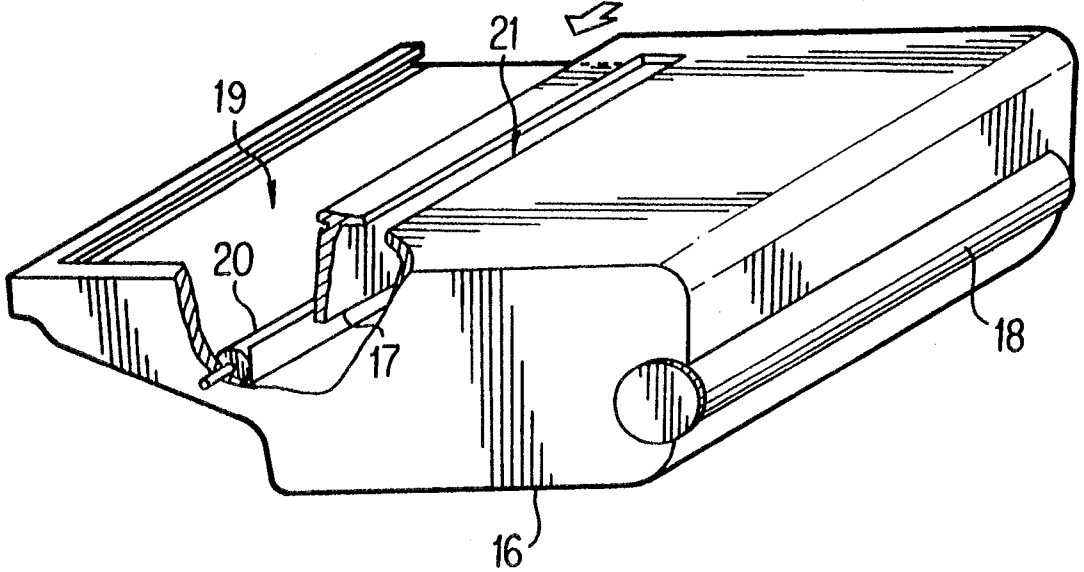

DEVELOPING DEVICE FOR IMAGE FORMING APPARATUS HAVING IMPROVED AIR/TONER FILTERING

BACKGROUND OF THE INVENTION

The present invention relates to a developing device for a copier, facsimile apparatus, printer or similar image forming apparatus and, more particularly, to a developing device operable with a developer cartridge mounted on, for example, the top of a hopper thereof.

A developing device of the type using a cartridge containing a toner or similar developer is extensively used today. It is a common practice with this type of developing device to provide, for example, a hopper with an air vent and cover it with a filter. When the cartridge is inserted into the hopper, air is forced out through the air vent while the filter catches the toner being entrained by the resulting stream of air. However, the problem with such a conventional device is that when the filter is stopped up by the toner, much time and labor is necessary for a serviceman to clean or replace it. Another conventional developing device is operable with a developer cartridge whose open bottom is hermetically closed by a seal member. This kind of cartridge is provided with a shutter for removing the seal member when the cartridge is mounted on the device. Specifically, after the cartridge has been mounted on a hopper, the shutter is manipulated to remove the seal member and cause a toner or similar developer to drop from the cartridge into the hopper. Such an approach, however, causes another problem that when the shutter is operated, the toner smears the outer periphery of the device around the cartridge and, in addition, the toner existing in the hopper leaks to the outside.

SUMMARY OF THE INVENTION

It is, therefore, an object of the present invention to provide a developing device which eliminates or reduces time and labor for the cleaning or replacement of a filter used to prevent a toner from leaking to the outside of the device or a filter used to prevent contamination by the toner.

It is another object of the present invention to provide a developing device capable of eliminating or reducing the leakage of a toner to the outside when a shutter closing the opening of a cartridge is moved into and out of the device.

In accordance with the present invention, a developing device for an image forming apparatus has an accommodating section for accommodating a cartridge containing a developer. The inner periphery of the accommodating section and the outer periphery of the cartridge are so configured as to form a clearance therebetween which has a predetermined sectional area and extends in the intended direction of cartridge insertion. A filter is provided on at least the leading end portion, with respect to the intended direction of cartridge insertion, of the outer periphery of the cartridge for blocking the clearance.

Also, in accordance with the present invention, a developing device for an image forming apparatus has a developer supply section formed with an opening in the upper portion thereof for receiving a developer from a cartridge containing the developer. The cartridge is capable of being mounted on the developer supply section in such a manner as to close the opening. A developing chamber accommodates a developer carrier for carrying the developer thereon and is formed with an opening through a part of the wall thereof for preventing pressure inside the developing chamber from rising excessively. A filter is provided on the cartridge for closing the opening of the developing chamber.

Further, in accordance with the present invention, a developing device for an image forming apparatus has a developer supply section formed with an opening in the upper portion thereof for receiving a developer from a cartridge containing the developer. The cartridge is capable of being mounted on the developer-supply section in such a manner as to close the opening. A developing chamber accommodates a developer carrier for carrying the developer thereon. A passageway provides communication between the developing chamber and a space substantially hermetically closed by the cartridge mounted on the developer supply section and the wall of the developer supply section. The cartridge comprises an opening formed in the peripheral wall thereof for preventing pressure inside the developing chamber from rising excessively, and a filter covering the opening.

Furthermore, in accordance with the present invention, a developing device for an image forming apparatus has a cartridge containing a developer, and a developer supply section formed with an opening in the upper portion thereof for receiving the developer from the cartridge. The cartridge is capable of being mounted on the developer supply section in such a manner as to close the opening. The cartridge comprises a shutter movable back and forth, when the cartridge is mounted on the developer supply section, between a first position where it covers the developer outlet of the cartridge in a space substantially hermetically closed by the cartridge and the wall of the developer supply section, and a second position where it is at least partly retracted from the space to uncover the developer outlet, and an opening formed in the peripheral wall thereof for communicating the space to the outside.

Moreover, in accordance with the present invention, a developing device for an image forming apparatus has a cartridge containing a developer, and a developer supply section formed with an opening in the upper portion thereof for receiving the developer from the cartridge. The cartridge is capable of being mounted on the developer supply section in such a manner as to close the opening. A developing chamber accommodates a developer carrier for carrying the developer thereon, and formed with an opening in a part of the wall thereof for preventing pressure inside the developing chamber from rising excessively. A filter closes the opening of the developing chamber. The cartridge comprises a shutter movable back and forth, when the cartridge is mounted on the developer supply section, between a first position where it covers the developer outlet of the cartridge in a space substantially hermetically closed by the cartridge and the wall of the developer supply section, and a second position where it is at least partly retracted from the space to uncover the developer outlet. A passageway provides communication between the space and the developing chamber.

In addition, in accordance with the present invention, a developing device for an image forming apparatus comprises a cartridge containing a developer, an accommodating section for receiving the cartridge, a developing chamber accommodating a developer carrier for carrying the developer thereon, and formed with an opening in a part of the wall thereof for preventing pressure inside the developing chamber from rising excessively, a filter closing the opening of the developing chamber, and a passageway providing communication between the developing chamber and the accommodating section into which the cartridge is being inserted.

BRIEF DESCRIPTION OF THE DRAWINGS

The above and other objects, features and advantages of the present invention will become more apparent from the following detailed description taken with the accompanying drawings in which:

FIG. 7A is an external perspective view, as seen from the rear, showing an alternative embodiment of the present invention;

FIG. 7B is a section along line X—X of FIG. 7A, showing a condition wherein a cartridge is mounted on the body of the device;

In the figures, the same or similar constituent parts are designated by the same reference numerals.

DESCRIPTION OF THE PREFERRED EMBODIMENTS

Figure 1:
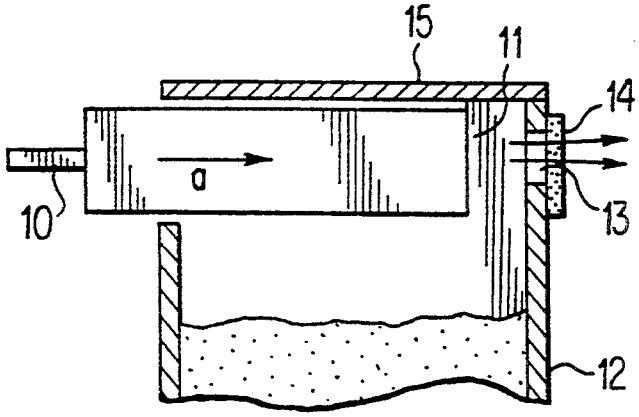
FIG. 1 PRIOR ART
FIG. 1 is a fragmentary section of a conventional developing device.

To better understand the present invention, a brief reference will be made to some conventional developing devices. FIG. 1 shows a first conventional developing device which is provided with a toner supply device (see Japanese Patent Laid-Open Publication (Kokai) No. 4-54952). As shown, the toner supply device has in the upper portion thereof a space 11 for receiving a cartridge 10 containing a developer or toner therein. A wall 12 delimits the inner end of the space, or cartridge accommodating section, 11 and has an air vent 13 formed therein. The air vent 13 is covered by a filter 14. In this configuration, when the cartridge 10 is inserted into the toner supply device in the direction indicated by an arrow a, air in the space 11 is forced out to the outside via the air vent 13 and filter 14. At this instant, the filter 14 prevents the toner from being entrained by air. In a developing device lacking the air vent 13, when the cartridge 10 is inserted as mentioned above, air in the space 11 will be compressed and leak to the outside together with the toner via the clearance between the cartridge 10 and a wall 15 surrounding it. As a result, the toner will contaminate the inside of an image forming apparatus in which the developing device is incorporated.

Figure 2:
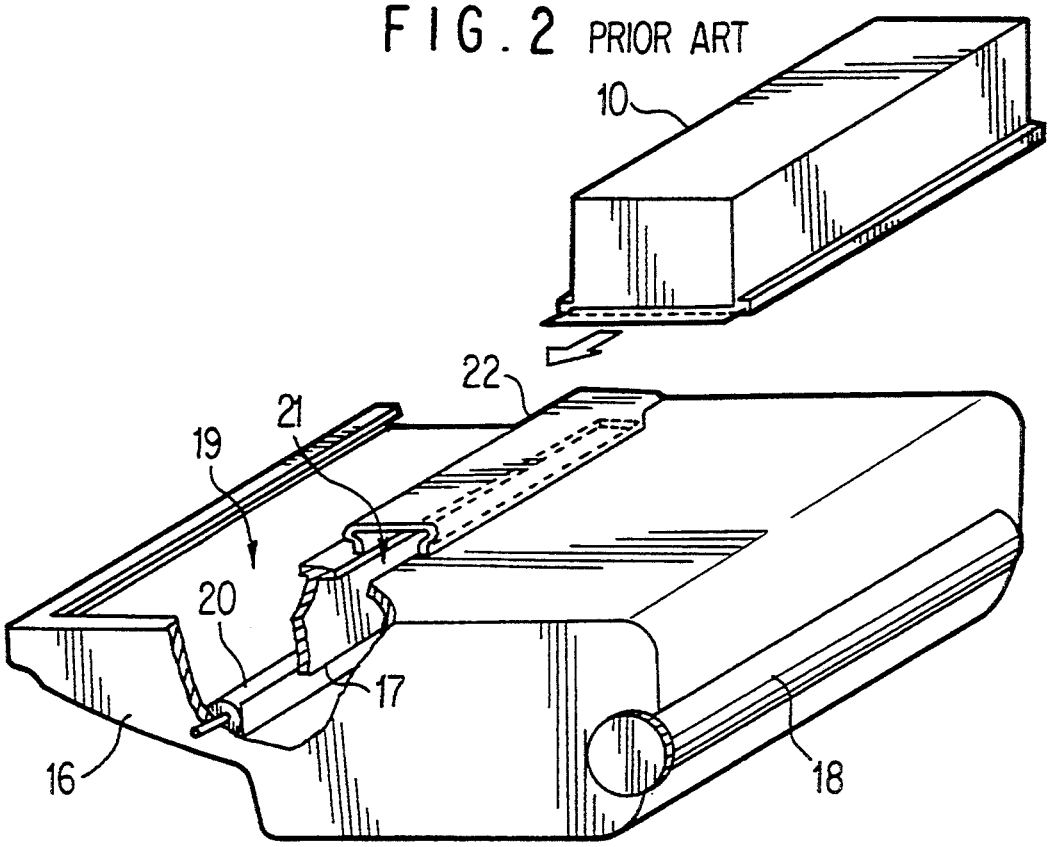
FIG. 2 PRIOR ART
FIG. 2 is an external perspective view of another conventional developing device.

FIG. 2 shows a second conventional developing device. As shown, a partition 17 divides the inside of the developing device into a developing chamber accommodating a developing roller 18 and other conventional members for development, and a hopper or developer supply section 19. The hopper 19 has an opening for receiving a developer or toner on the top thereof. A toner cartridge 10 is removably mounted on the hopper 19. A toner supply roller 20 is located at a position where the developing chamber and hopper 19 are in communication with each other. The roller 20 supplies a toner existing in the hopper 19 to the developing chamber, while isolating the two compartments from each other. An air vent 21 is formed through the top wall of the developing chamber and is covered by a filter 22. While the device is in operation, air flows into the developing chamber by a pumping action occurring around the opening of the casing 16 through which the developing roller 18 is partly exposed to the outside. This part of the air is discharged to the outside via the air vent 21 and filter 22. The filter 22 catches a toner being entrained by the stream of air. Should the air vent 21 be absent, air in the developing chamber would be excessively compressed and leak to the outside via a clearance between the developing roller 18 and a seal sealing the opening around the roller 18, while entraining the toner; the toner would contaminate the inside of the image forming apparatus.

Figure 3A:
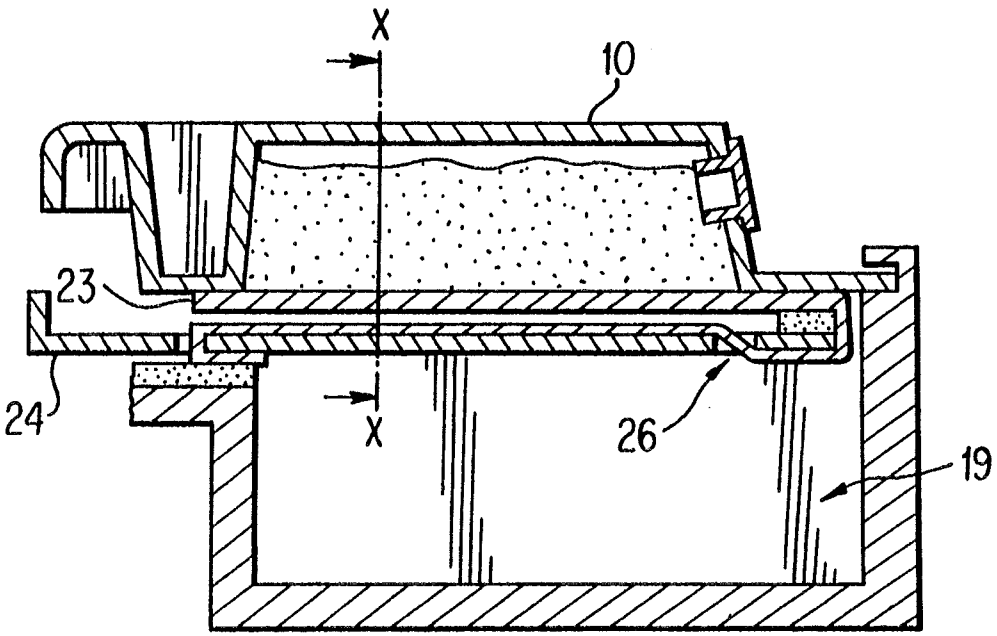
FIG. 3A PRIOR ART
FIG. 3A is a fragmentary section showing another conventional developing device.
Figure 3B:
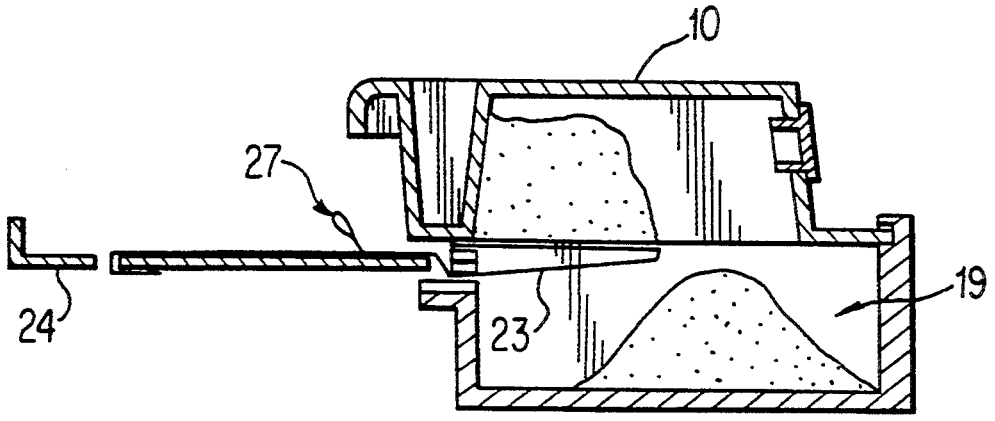
FIG. 3B PRIOR ART
FIGS. 3B and 3C are sections demonstrating how a cartridge mounted on the device of FIG. 3A is unsealed.
Figure 3C:
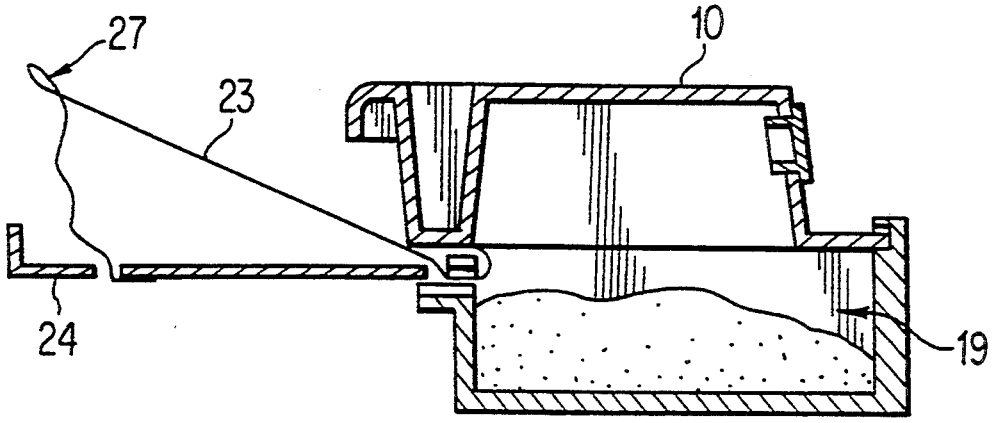
FIG. 3C PRIOR ART

FIG. 3A shows a third conventional developing device while FIGS. 3B and 3C show a procedure for unsealing a toner cartridge 10 set on the device. The cartridge 10 is shown in an external view in FIG. 4A. FIG. 4B is a section along line X—X of FIG. 4A. As shown, the developing device has a hopper 19 formed with an opening for receiving a toner at the top thereof and capable of accommodating the cartridge 10. The cartridge 10 is open at the bottom thereof and has the opening hermetically closed by a seal 23. A shutter 24 covers the entire opening of the cartridge 10 which is closed by the seal 23. The shutter 24 is slidably mounted on a shutter guide 25 (see FIG. 4B). The seal 23 is substantially twice as long as the bottom opening of the cartridge 10. As shown in FIG. 3A specifically, the seal 23 is adhered to the edges of the opening of the cartridge 10 with one half thereof covering the opening, turned down to the lower surface of the shutter 24 by way of the inner end, as viewed in the figures, of the shutter 24, and then returned to the upper surface of the shutter 24 via a slit 26 formed in the outer end, as viewed in the figures, of the shutter 24. The other half of the seal 23 is extended to the outer end portion of the shutter 24 and adhered thereto. In this configuration, the cartridge 10 is removably mounted on the top of the hopper 19, as shown in FIG. 3A. Then, the shutter 24 is pulled out to uncover substantially one half of the bottom opening of the cartridge 10, as shown in FIG. 3B. Subsequently, as shown in FIG. 3C, a tab 27 forming part of the seal 23 is pulled to uncover the other half of the bottom opening of the cartridge 10 with the result that the toner drops into the hopper 19. Finally, the shutter 24 is pushed into the device as far as the position where it covers the bottom opening of the cartridge 10. In this condition, the empty cartridge 10 is used as a closure member closing the top of the hopper 19.

In this conventional device, while the top opening of the hopper 19 is substantially hermetically closed by the cartridge 10, the shutter 24 and seal 23 are manipulated to supplement the toner from the cartridge 10 to the hopper 19. Hence, the toner in the hopper 19 is prevented from being scattered around in the event that the cartridge 10 is unsealed. In addition, the cartridge 10 is easy to handle.

However, the first and second conventional devices have some problems left unsolved, as follows. The filter 14 or 22 is affixed to the casing of the device in such a manner as to cover the air vent 13 or 21 which is formed in the wall surrounding the space 11 or the top wall of the developing chamber. Therefore, when the filter 14 or 22 is stopped up by the toner, much time and labor is necessary for, for example, a serviceman to clean or replace the filter 14 or 22. On the other hand, assume that the first and second conventional devices are simply combined to protect the inside of the developing device from contamination in the event that the cartridge is inserted and during the course of development. Then, both the filter 14 associated with the space 11 and the filter 22 associated with the developing chamber have to be cleaned or replaced, resulting in more time- and labor-consuming work.

The problem with the third conventional device is that when the shutter 24 is pulled out of the device and then pushed into the device, the toner smears the outer periphery of the wall of the hopper 19 surrounding the cartridge 10. This contamination becomes more problematic when the shutter 24 is pushed into the device at higher speed as far as the position where it covers the empty cartridge 10. Specifically, when the cartridge 10 is unsealed, the shutter 24 is moved out of and then into the space which is substantially hermetically closed by the walls of the hopper 19 and the cartridge 10. Experiments showed that an amount of air corresponding to the volume of the shutter 24 flows into and out of the above-mentioned space via the small clearance between the wall of the hopper 19 and the cartridge 10 (this clearance is usually dimensioned as small as possible to prevent the toner from being scattered around). Particularly, when the shutter 24 was moved into the space, an amount of air equal to the volume of the shutter 24 was blown out of the space at a substantial flow rate while entraining the toner out of the hopper 19.

Preferred embodiments of the present invention will be described hereinafter which are free from the above-discussed problems. The embodiments are each implemented as a developing device applicable to an electrophotographic copier and using a two component type developer, i.e., a toner and carrier mixture.

[1st Embodiment]

Figure 5A:
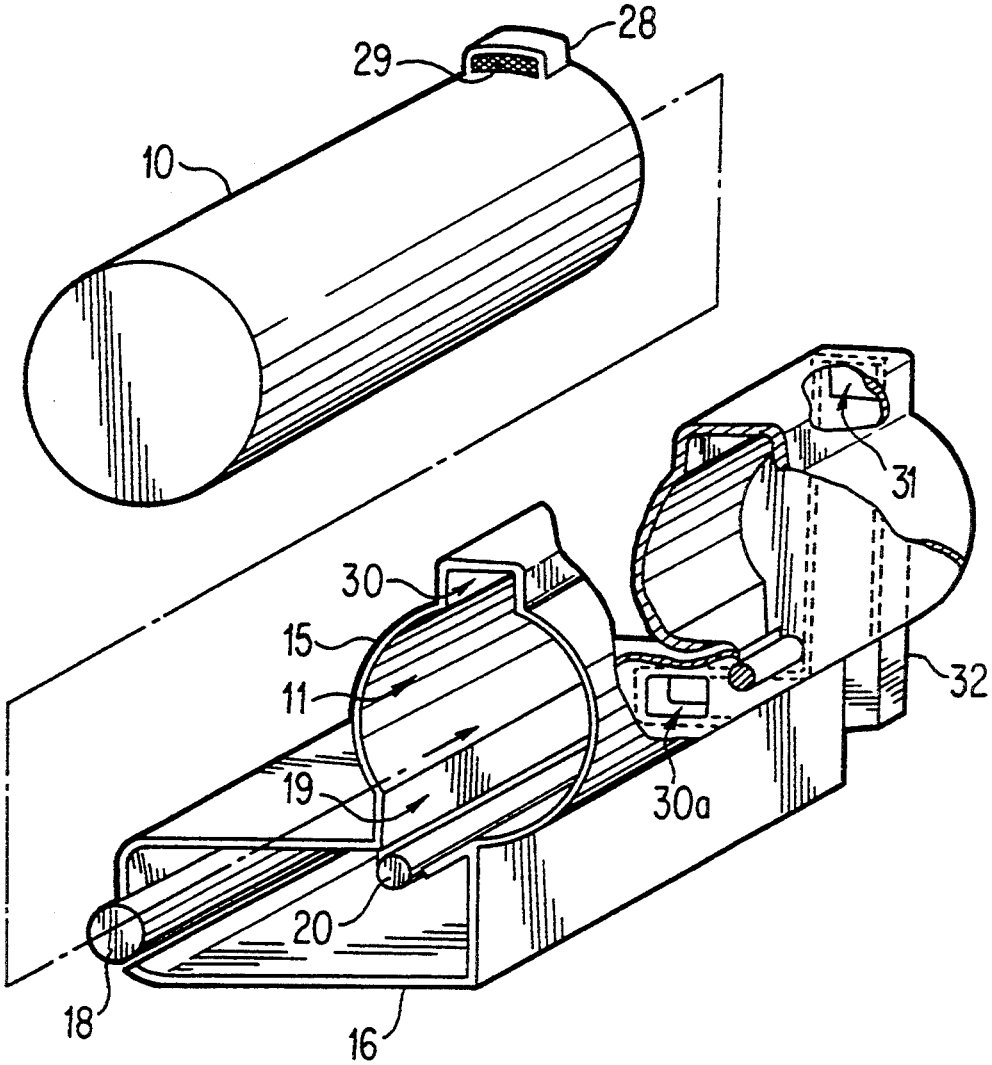
FIG. 5A is an external perspective view of a developing device embodying the present invention.

This embodiment pertains to a developing device of the type shown in FIG. 5A and having the space 11 for receiving the cartridge 10. Briefly, in the illustrative embodiment, the inner periphery of the device defining the space 11 and the outer periphery of the cartridge 10 are so configured as to form a clearance therebetween which extends in the direction of insertion of the cartridge 10 and has a predetermined sectional area. A filter is provided on the outer periphery of at least the leading end, with respect to the direction of insertion, of the cartridge 10 so as to block the clearance.

Figure 5B:
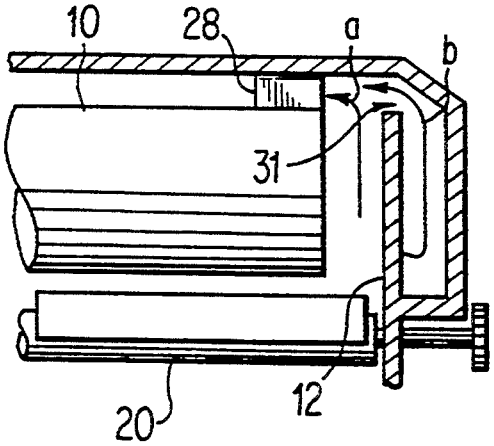
FIG. 5B is a fragmentary section of the embodiment.

Specifically, as shown in FIGS. 5A and 5B, the embodiment uses a hollow cylindrical cartridge 10 and has a casing 16. The casing 16 is provided with a hollow cylindrical space 11 for accommodating the cartridge 10 in the upper portion thereof. A holder portion 28 protrudes from the outer periphery of the leading end of the cartridge 10 and holds a filter 29 therein. A wall 15 defining the space, or cartridge accommodating portion, 11 is configured such that the top thereof protrudes outward over the entire length in the direction of cartridge insertion. Such a protrusion of the wall 15 forms a space 30 for the holder portion 28 of the cartridge 10 to move. In the direction perpendicular to the direction of cartridge insertion, the space 30 has a section slightly greater than the section of the holder portion 28. This allows the holder portion 28 to move in the space 30 while substantially blocking it. The bottom of the space 11 is provided with a trough-like configuration communicating with a developing chamber in which a developing roller 18 is located, thereby forming a hopper 19. A toner discharged from an opening, not shown, formed in the cartridge 10 is received by the hopper 19. A toner supply roller 20 is located at a position where the hopper 19 and developing chamber communicate, thereby isolating them from each other. The roller 20 is rotatable to supplement the toner from the hopper 19 to the developing roller.

The space 11 and developing chamber are positioned at the rear side of the device and are in communication with each other by way of a duct 32. The duct 32 has openings **30*a* and 31 at opposite ends thereof. The opening 30*a* is open to the developing chamber via the inner wall of the chamber while the opening 31 is open to the space 11 via an inner wall 12 which delimits the space 11. Preferably, the opening 30*a* open to the developing chamber should be positioned at a level or height which prevents the developer in the chamber from entering the duct 32. The other opening 31 of the duct 32 corresponds in position to the previously mentioned space 30 of the wall 15. Therefore, assuming that the cartridge 10 is in a fully inserted position when abutted against the wall 12, the developing chamber is held in communication with the outside environment via the filter 29 and space 30 even when the cartridge 10 is in the fully inserted position. FIG. 5B shows a condition wherein the cartridge 10 is inserted halfway toward the wall 12**.

In operation, the cartridge 10 is inserted into the space 11 with the holder portion 28 thereof received in the space 30 and by being guided by the wall around the space 30. At this instant, the space 30 is blocked by the holder portion 28 and filter 29. As the cartridge 10 is moved deeper into the space 11, an amount of air equal to the volume of the part of the cartridge 11 existing in the space 10 is forced out via the filter 29, the space 30 outside of the filter 29, and the outermost end of the space 30, as indicated by an arrow a in FIG. 5B. Since the filter 29 removes the toner from the stream of air, the toner is prevented from being discharged to the outside of the device.

During the course of development, a pumping action occurs in the vicinity of the opening of the casing 16 through which the developing roller 18 is partly exposed to the outside. Air introduced into the developing chamber by the pumping action flows into the duct 32 via opening 30*a* via the duct 32, as indicated by an arrow b in FIG. 5B. This part of the air is discharged to the outside via the filter 29, a part of the space 30 outside of the filter 29, and the outermost end of the space 30. Again, since the filter 29 removes the toner from the stream of air, the toner is prevented from being discharged to the outside of the device.

In the illustrative embodiment, the developing chamber and the space 11 are in communication with each other by way of the duct 32 so as to use the filter 29 and space 30 for the purpose of preventing the pressure inside the chamber from rising during development. Alternatively, the developing chamber and the space 11 can be isolated from each other so that the filter 29 and space 30 only exist for the purpose of intercepting the toner.

To provide communication between the developing chamber and the space 11, the duct 32 may be replaced with, for example, an opening formed in the wall partitioning the hopper 19 and the developing chamber.

Figure 6:
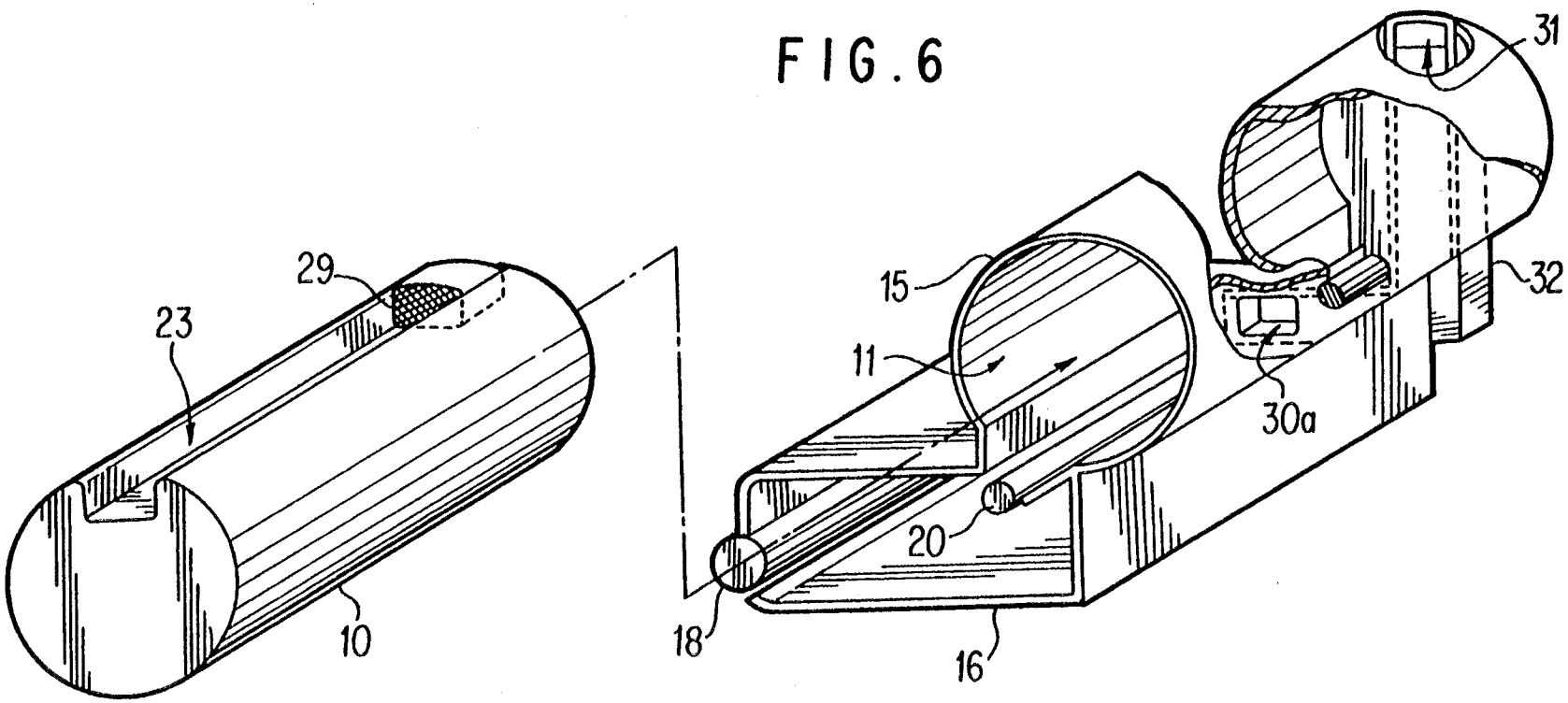
FIG. 6 is an external perspective view showing a modification of the embodiment.

In the illustrative embodiment, the upward projection or space 30 of the wall 15 serves as a passageway for discharging air to the outside when the cartridge 10 is inserted into the space 11. FIG. 6 shows an alternative approach for implementing such a passageway. As shown, the cartridge 10 is provided with a recess 33 over the entire length thereof. In this case, the filter 29 is affixed to the leading end of the cartridge 10 with respect to the direction of cartridge insertion so as to block the clearance between the recess 33 and the wall 15 surrounding it.

Figure 12:
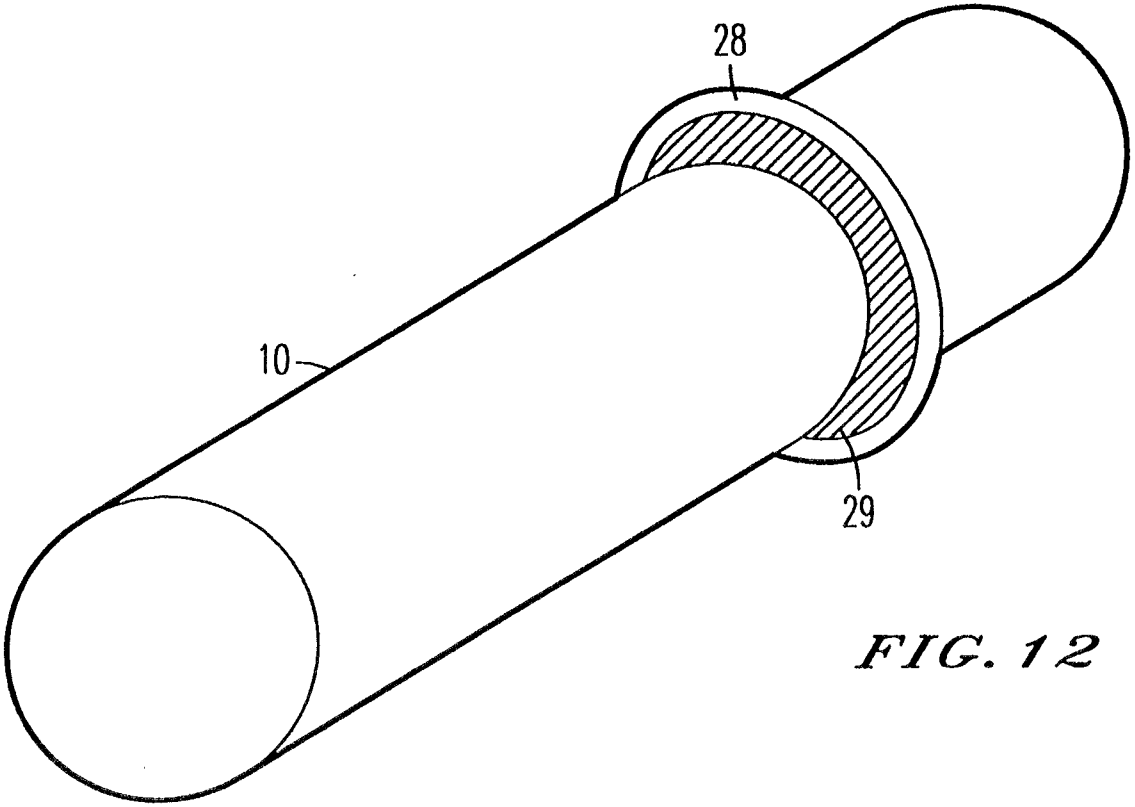
FIG. 12 shows a further embodiment of the invention where the filter is provided around the entire circumference of the cartridge 10.

Further, in this embodiment, the holder portion 28 and space 30 are positioned such that the holder portion 28 and filter 29 begin to block the space 30 as soon as the cartridge 10 is brought to the inlet of the space 11. This starts preventing the toner from leaking through the space 30 at the initial stage of cartridge insertion. However, when the toner is not likely to leak at the initial stage of cartridge insertion, the holder portion 28 and filter 29 may be provided on the trailing end portion of the cartridge 10 with respect to the direction of cartridge insertion. If desired, the holder portion 28 and filter 29 may even be provided over the entire length of the cartridge 10. Furthermore, the filter 29 may be provided over the entire circumference of the cartridge 10, in which case the inside diameter of the wall 15 will be increased to accommodate the thickness of the filter 29, as shown in FIG. 12.

[2nd Embodiment]

Referring to FIGS. 7A and 7B, an alternative embodiment of the present invention will be described which pertains to a developing device of the type shown in FIG. 2 and having the air vent 21 in the top wall of the developing chamber. Briefly, this embodiment differs from the device of FIG. 2 in that the filter 22 for covering the air vent 21 is mounted on the cartridge 10.

Specifically, as shown in FIGS. 7A and 7B, the filter 22 is mounted on the cartridge 10 via a mounting plate 34. The mounting plate 34 plays the role of a filter holder which allows the filter 22 to cover the air vent 21 when the cartridge 10 is mounted on the top of the hopper 19. As shown in FIG. 7B, the mounting plate 34 is formed with an opening 35 which is aligned with the air vent 21. In this configuration, air which flows through the air vent 21 and opening 35 is discharged to the outside via the filter 22.

As stated above, the filter 22 is mounted on the cartridge 10 and, therefore, can be removed from the hopper 19 together with the cartridge 10. Hence, when the cartridge 10 is replaced, the filter 22 is automatically replaced. Also, the filter 22 can be cleaned with ease merely by removing the cartridge 10.

As shown in FIGS. 7A and 7B, use may be made of the cartridge 10 associated with the device of FIGS. 3A–3C, 4A and 4B and having the shutter 24 for removing the seal 23. In this case, when the shutter 24 is moved into and out of the space substantially hermetically closed by the cartridge 10 and the wall of the hopper 19, particularly when it is moved into such a space, it is likely that air equal in amount to the volume of the shutter 24 is blown out via the small clearance between the wall of the hopper 19 and the cartridge 10. To eliminate this problem, a passageway providing communication between the above-mentioned space and the developing chamber may be formed to introduce an amount of air corresponding to the volume of the shutter 24 into the developing chamber. Then, this part of the air will be discharged to the outside via the air vent 21 of the developing chamber and the filter 22 covering it. The passageway may be implemented by the duct 32 shown in FIGS. 5A, 5B or FIG. 6 or by an opening formed in a predetermined position of the partition 17, preferably a position which prevents the toner in the hopper 19 and the developer in the developing chamber from entering the passageway.

[3rd Embodiment]

Figure 8A:
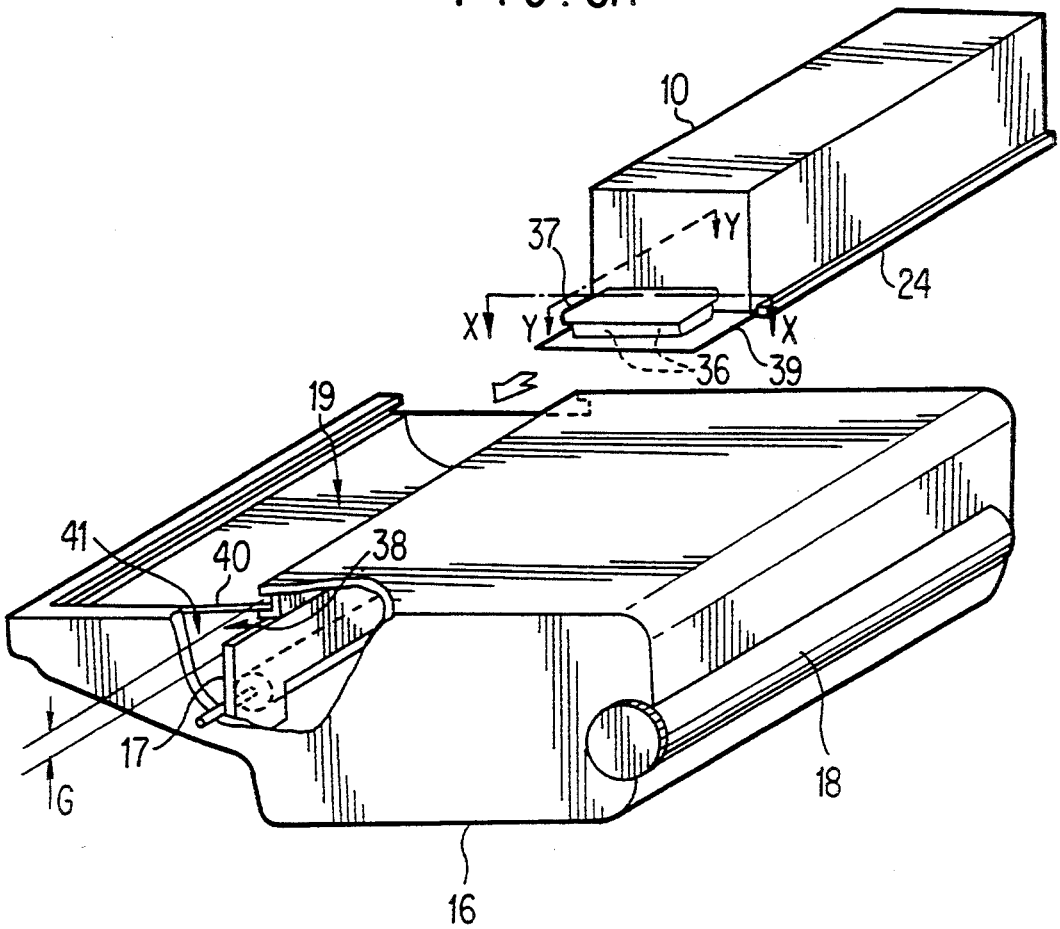
FIG. 8A is an external perspective view, as seen from the rear, showing another alternative embodiment of the present invention.
Figure 8B:
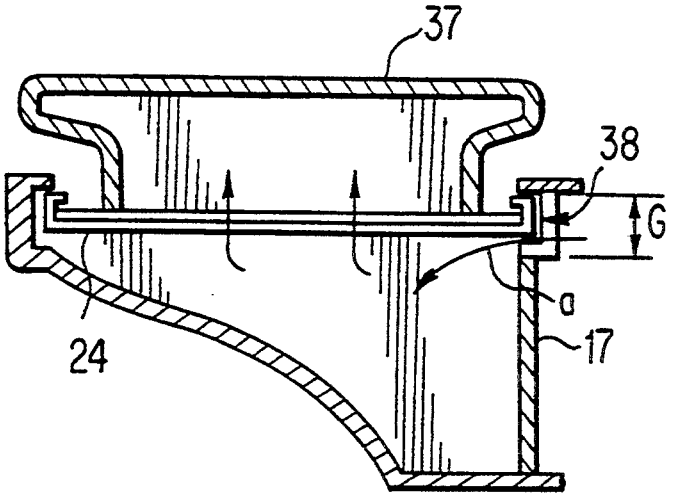
FIG. 8B is a section along line X—X of FIG. 8A, showing a condition wherein a cartridge is mounted on the body of the device.
Figure 8C:
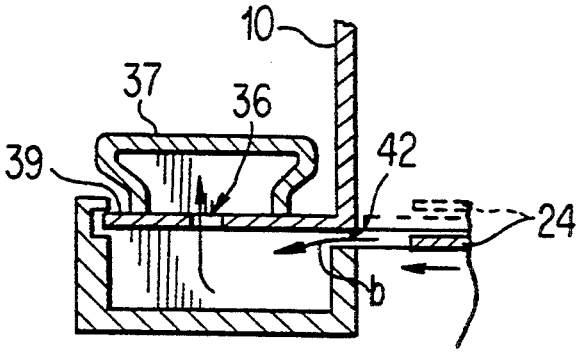
FIG. 8C is a section along line Y—Y of FIG. 8A.

FIGS. 8A–8C show another alternative embodiment of the present invention and also pertains to a developing device of the type shown in FIG. 2 and mounting the cartridge 10 on the top of the hopper 19 in such a manner as to block the toner inlet. Briefly, in this embodiment, a passageway is formed which provides communication between the developing chamber and the space substantially hermetically closed by the cartridge 10 and the wall of the hopper 19. Openings 36 are formed in the cartridge 10 to prevent the pressure inside the developing chamber from rising excessively. Further, a filter 37 is affixed to the cartridge 10 to cover the openings 36.

Specifically, as shown in FIGS. 8A–8C, the cartridge 10 is mounted on the device to hermetically close the toner inlet of the hopper 19. An opening 38 is formed in a part of the partition 17 which divides the hopper 19 and the developing chamber from each other. The openings 36 are formed in the cartridge 10 to discharge air flowing from the developing chamber into the hopper 19 via the opening 38, thereby preventing the pressure inside the developing chamber from rising excessively. The openings 36 are covered by filter 37. More specifically, the openings 36 are formed in a flange 39 which extends horizontally from the lower edge of the leading end of the cartridge 10 with respect to the direction of cartridge insertion. The filter 37 is fitted on the upper surface of the flange 39 to cover the openings 36.

In this particular embodiment, a partition 40 is positioned at the inner end of the hopper 19 to form a space 41. Air flowing from the developing chamber via the opening 38 directly enters the space 41. When the cartridge 10 is positioned on top of the hopper 19, the flange 39 is positioned above the space 41 and serves as a lid. As shown in FIG. 8C, a gap 42 is formed between the upper end of the partition 40 and the lower end of the flange 39, so that the hopper 19 and the space 41 are in communication with each other.

In operation, while development is under way, air flows into the developing chamber due to a pumping action occurring in the vicinity of the opening of the casing 16 through which the developing roller 18 is partly exposed to the outside. This part of the air flows further into the space 41 via the opening 38, as indicated by an arrow a in FIG. 8B. Then, the air stream is discharged to the outside via the openings 36 of the flange, or lid, 39 of the cartridge 10 and the filter 37. As a result, air discharged to the outside does not contain toner particles which would otherwise contaminate the outside of the device.

As shown in FIG. 8C, the hopper 19 is in communication with space 41 via the gap 42 between the upper end of partition 40 and the lower end of flange 39. Hence, when the shutter 24 is moved into and out of the space substantially hermetically closed by the cartridge 10 and the wall of the hopper 19, particularly when it is moved into such a space, in order to unseal the cartridge 10, air equal in amount to the volume of the shutter 24 is forced into the space 41 via the gap 42. This part of the air is discharged to the outside via the openings 36 of the flange 39 of the cartridge 10 and the filter 37. The filter 37 filters out the toner being entrained by the air stream.

While the filter 37 has been shown and described as being fitted on the upper surface of the flange 39, it may be provided on the leading end of the shutter 24, which is movable back and forth, so as to cover the openings 36 from below the flange 39.

[4th Embodiment]

A reference will be made to FIGS. 9A and 9B for describing another alternative embodiment of the present invention. This embodiment uses a toner cartridge of the type shown in FIGS. 3A–3C, 4A and 4B. As shown, the cartridge 10, like the cartridge 10 of FIG. 8A, is provided with a flange 39 extending horizontally from the lower edge of the leading end of the cartridge 10. The openings 36 are also formed in the flange 39 for discharging air which flows from the developing chamber into the hopper 19 to the outside. Further, as shown in FIG. 9A, the leading end of the shutter 24 closes the openings 36 when it is returned, after the cartridge 10 has been unsealed, to the position where it blocks the toner outlet of the cartridge 10.

In the above configuration, when the shutter 24 is moved into and out of the space substantially hermetically closed by the cartridge 10 and the wall of the hopper 19, particularly when it is moved into such a space, in order to unseal the cartridge 10, air equal in amount to the volume of the shutter 24 is forced into the space 41 via the gap 42. This part of the air is discharged to the outside the via the openings 36 of the flange 39 of the cartridge 10. At this instant, the flow rate of air flowing through the openings 36 depends on the area of the openings 36 and the returning speed of the shutter 24. Hence, if the area of the openings 36, for example, is so selected as to set up a sufficiently low flow rate, it is possible to release only the amount of air corresponding to the volume of the shutter 24 slowly to the outside without entraining the toner out of the hopper 19.

Figure 9A:
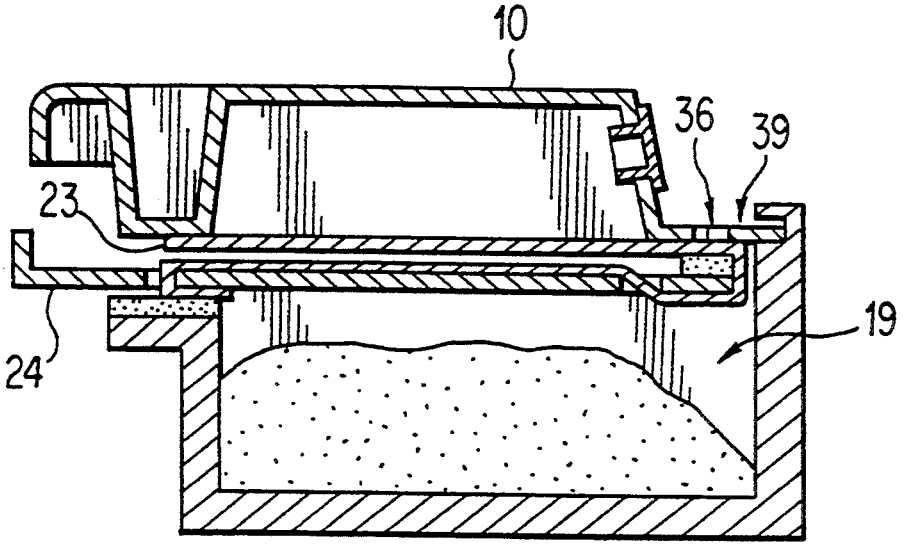
FIG. 9A is a fragmentary section showing still another alternative embodiment of the present invention.
Figure 9B:
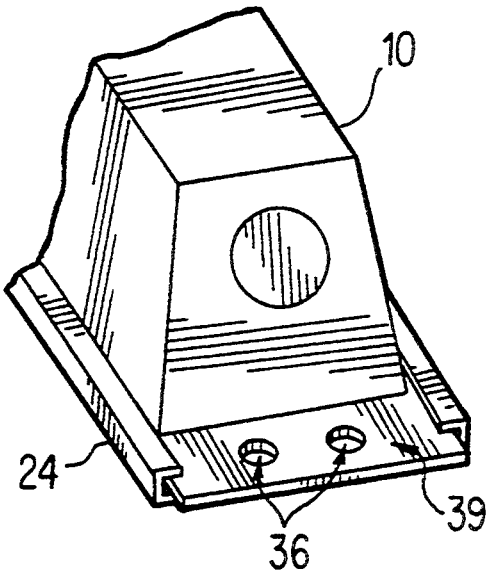
FIG. 9B is a fragmentary external perspective view of a cartridge included in the embodiment of FIG. 9A.

Further, as shown in FIG. 9A, the leading end of the shutter 24 blocks the openings 36 of the flange 39 when the shutter 24 is fully inserted into the device. In this condition, even when the toner supply roller 20 is driven to supplement the toner from the hopper 19 to the developing chamber, the toner filling the hopper 19 is prevented from leaking to the outside.

Figure 10A:
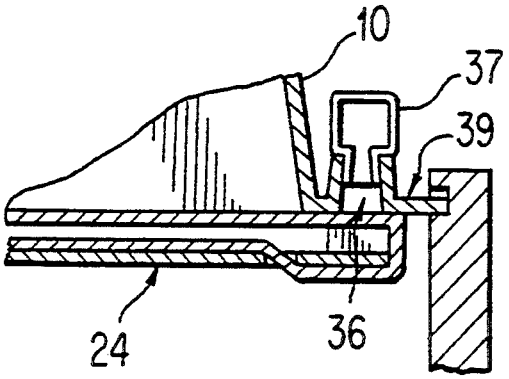
FIG. 10A is a fragmentary enlarged view of a modification of the embodiment shown in FIGS. 9A and 9B.
Figure 10B:
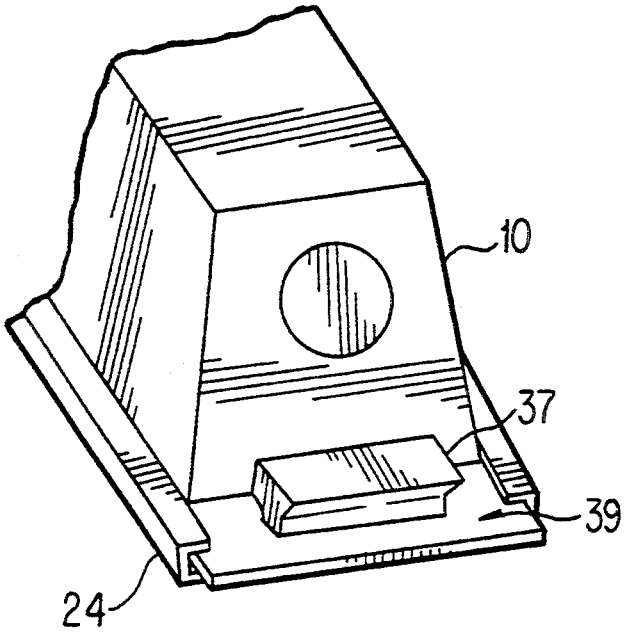
FIG. 10B is a fragmentary perspective view of a cartridge included in the modification of FIG. 10A.

As shown in FIGS. 10A and 10B, the filter 37 may be provided on the flange 39 to cover the openings 36 in order to fully eliminate the leakage of the toner via the opening 36.

Figure 11:
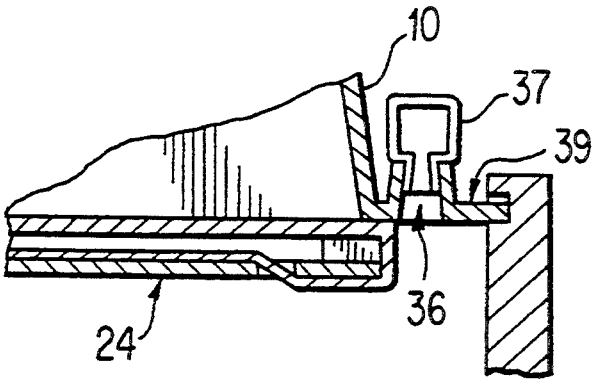
FIG. 11 is a fragmentary enlarged section showing another modification of the embodiment shown in FIGS. 9 A and 9B.

In addition, to prevent the pressure inside the developing chamber from rising excessively, a passageway may be formed for providing communication between the developing chamber and the space substantially hermetically closed by the cartridge 10 and the wall of the hopper 19. The passageway may be implemented by the duct 32 shown in FIGS. 5A, 5B or FIG. 6 or by an opening formed in a predetermined position of the partition 17, preferably a position which prevents the toner in the hopper 19 and the developer in the developing chamber from entering the passageway. In this case, the leading end of the shutter 24 will not close the openings 36 of the flange 39 even during development, as shown in FIG. 11.

5th Embodiment]

Figure 4A:
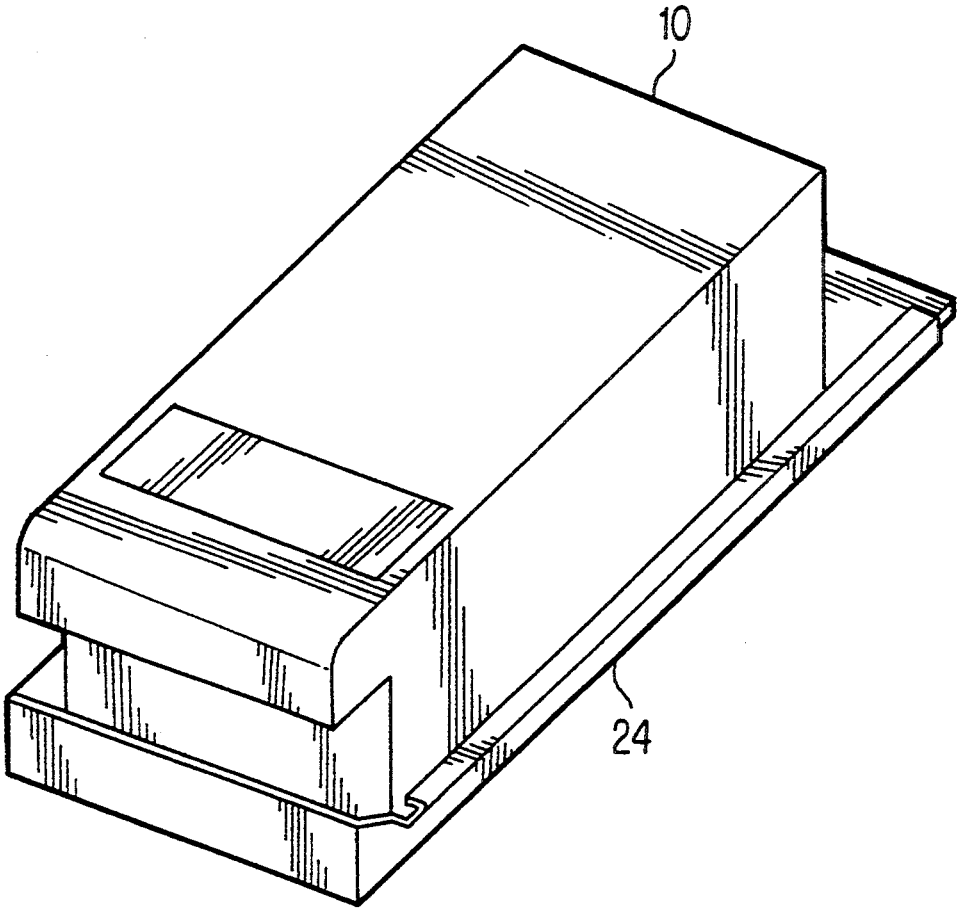
FIG. 4A PRIOR ART
FIG. 4A is an external perspective view of the cartridge shown in FIGS. 3A-3C.
Figure 4B:
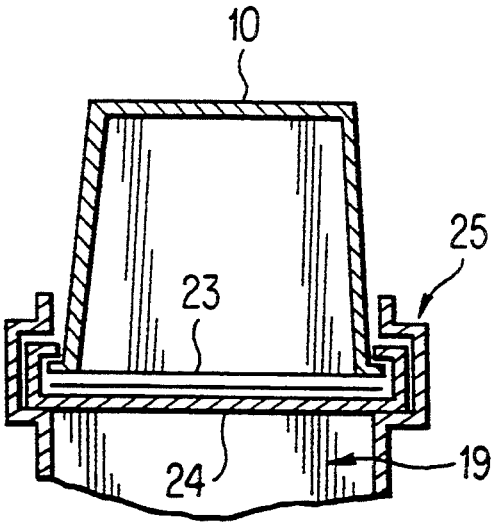
FIG. 4B PRIOR ART
FIG. 4B is a section along line X—X of FIG. 3A.

Assume a developing device of the type shown in FIGS. 4A and 4B and in which the cartridge 10 is mounted on the top of the hopper 19 in such a manner as to close the toner inlet. This kind of cartridge 10 is provided with the shutter 24 movable back and forth between a position where it blocks the toner outlet of the cartridge 10 in the space substantially hermetically closed by the cartridge 10 and the wall of the hopper 19, and a position where it is at least partly retracted from such a space to unblock the toner outlet, as stated earlier. In this type of device, when the shutter 24 is moved into and out of the space delimited by the cartridge 10 and the wall of the hopper 19, particularly when it is moved into the space, air equal in amount to the volume of the shutter 24 is apt to flow out via the small clearance between the wall of the hopper 19 and the cartridge 10.

To eliminate this problem, the fifth embodiment forms a passageway for providing communication between the developing chamber and the space substantially hermetically closed by the cartridge 10 and the wall of the hopper 19 in the developing device of the type shown in, for example, FIG. 2. Specifically, the device of FIG. 2 has the air vent 21 in the top wall of the developing chamber for preventing the pressure inside the chamber from rising excessively, and the filter 22 affixed to the top wall to cover the air vent 21. In accordance with the illustrative embodiment, the passageway may be implemented by the duct 32 shown in FIGS. 5A and 5B or FIG. 6 or an opening formed in a predetermined position of the partition 17, preferably a position which prevents the toner in the hopper 19 and the developer in the developing chamber from entering the passageway. In this construction, the air vent 21 and filter 22 can also be used to prevent the toner from being blown out when the shutter 24 is moved.

Assume that the air vent 21 and filter 22 are associated with, for example, the top wall of the developing chamber, as shown in FIG. 2. Then, even in the device of the type shown in FIGS. 5A and 5B or FIG. 6 and having the cartridge 10 movable into the space 11, the toner is prevented from leaking when the cartridge 10 is inserted into the space 11, since the developing chamber and the space 11 are in communication with each other by way of the duct 32 (see FIGS. 5A and 5B or FIG. 6). In this case, it is not necessary to form the passageway for discharging air equal in amount to the volume of the part of the cartridge 10 existing in the space 11 to the outside or to provide the filter 29 for blocking the passageway.

While the embodiments have concentrated on a developing device using a two component type developer, they are also practicable with a one component type developer, i.e., toner stored in the cartridge 10. Regarding a developing device operable with a one component type developer, if a casing has the space thereof for receiving the toner from the cartridge 10 and the space adjoining a developing roller isolated by a toner conveyor member, partition and so forth, the two spaces of the casing may be in communication with each other. Then, an opening and a filter for preventing the toner from being scattered around when the cartridge 10 or the shutter 24 is inserted can also be used to prevent the pressure around the developing roller from rising excessively. Conversely, an opening and a filter for eliminating the excessive rise of the pressure around the developing roller can also be used to prevent the toner form being scattered around.

As to the filter, use may be made of an electrostatic filter Elitolon (trade name) available from Toyobo (Japan) or FM-65N or AC-225F (trade name) available from Japan Vilene (Japan).

In summary, it will be seen that the present invention provides a developing device capable of preventing a developer from leaking to the outside when a cartridge is inserted into the device. This protects the space around the developing device from contamination due to the developer. When the cartridge is replaced, a filter provided thereon is automatically replaced. The filter can be cleaned with ease merely by removing the cartridge from the device.

Further, the device of the present invention prevents the pressure inside a developing chamber from increasing excessively, while preventing the developer from contaminating the space around the device. Specifically, a predetermined clearance and a filter closing it can be used to eliminate both the leakage of toner when the cartridge is inserted and the excessive rise of pressure inside the developing chamber during development. Hence, the time and labor for replacing or cleaning the filter are reduced, compared to a case wherein a different filter is to perform these two different functions.

Moreover, an opening is formed in a part of the wall of the developing chamber for eliminating the excessive rise of pressure inside the chamber. This opening and a filter closing it cooperate to prevent the developer from leaking to the outside when a shutter provided on the cartridge is inserted into a hermetically closed space. In this sense, the opening and filter implement both the prevention of the leakage of toner when the cartridge is inserted and the prevention of the excessive rise of pressure inside the developing chamber during development. Hence, the time and labor for replacing or cleaning the filter are reduced, compared to a case wherein a different filter is used to perform the two different functions.

In addition, when the shutter is brought to a position where it covers the developer outlet of the cartridge, an opening provided for communication with the outside is blocked. Therefore, even when the developer is scattered in the device during development, it is prevented from leaking to the outside via the opening.

Various modifications will become possible for those skilled in the art after receiving the teachings of the present disclosure without departing from the scope thereof.

What is claimed is:

1. A developing device for an image forming apparatus, comprising:

a developer supply section formed with an opening in an upper portion thereof for receiving a developer from a cartridge containing said developer, said cartridge being capable of being mounted on said developer supply section in such a manner as to close said opening;

a developing chamber accommodating a developer carrier for carrying the developer thereon, and formed with an opening through a part of a wall thereof for preventing pressure inside said developing chamber from rising excessively; and a filter provided on said cartridge in a longitudinally extending recess formed in said cartridge for closing said opening of said developing chamber.

2. A device as claimed in claim 1, wherein said cartridge comprises a shutter movable back and forth, when said cartridge is mounted on said developer supply section, between a first position where said shutter covers a developer outlet of said cartridge in a space substantially hermetically closed by said cartridge and a wall of said developer supply section, and a second position where said shutter is at least partly retracted from said space to uncover said developer outlet;

said device further comprising a passageway for providing communication between said developing chamber and said space.

3. A developing device for an image forming apparatus, comprising:

a developer supply section formed with an opening in an upper portion thereof for receiving a developer from a cartridge containing said developer, said cartridge being capable of being mounted on said developer supply section in such a manner as to close said opening;

a developing chamber for accommodating a developer carrier for carrying the developer thereon; and a passageway for providing communication between said developing chamber and a space substantially hermetically closed by said cartridge mounted on said developer supply section and a wall of said developer supply section;

said cartridge comprising a mounting plate attached to a side wall of said cartridge on which a filter is disposed for covering an opening formed in said mounting plate which is aligned with an opening formed in said developing chamber for preventing pressure inside said developing chamber from rising excessively.

4. A device as claimed in claim 3, wherein said cartridge comprises:

a shutter movable back and forth, when said cartridge is mounted on said developer supply section, between a first position where said shutter covers a developer outlet of said cartridge in a space substantially hermetically closed by said cartridge and a wall of said developer supply section, and a second position where said shutter is at least partly retracted from said space to uncover said developer outlet;

said opening for preventing the pressure inside said developing chamber from rising excessively adjoining said shutter when said shutter is brought to said first position;

said filter closing said opening when said shutter is held in said first position.

5. A developing device for an image forming apparatus, comprising:

a cartridge for containing a developer;

a developer supply section formed with an opening in an upper portion thereof for receiving the developer from said cartridge, said cartridge being capable of being mounted on said developer supply section in such a manner as to close said opening;

said cartridge comprising a shutter movable back and forth, when said cartridge is mounted on said developer supply section, between a first position where said shutter covers a developer outlet of said cartridge in a space substantially hermetically closed by said cartridge and a wall of said developer supply section, and a second position where said shutter is at least partly retracted from said space to uncover said developer outlet, and at least one opening formed in a flange member coupled to said cartridge for providing communication between said space and the outside environment in which said developing device is located.

6. A device as claimed in claim 5, further comprising a filter provided on said cartridge and closing said opening of said cartridge.

7. A device as claimed in claim 6, further comprising a developing chamber for accommodating a developer carrier for carrying the developer thereon, and formed with an opening in a part of a wall thereof for preventing pressure inside said developing chamber from rising excessively; and a passageway for providing communication between said developing chamber and said space.

8. A device as claimed in claim 5, wherein said at least one opening for providing communication between said space and the outside environment is closed when said shutter is held in said first position.

9. A developing device for an image forming apparatus, comprising:

a cartridge for containing a developer;

a developer supply section formed with an opening in an upper portion thereof for receiving the developer from said cartridge, said cartridge being capable of being mounted on said developer supply section in such a manner as to close said opening;

a developing chamber for accommodating a developer carrier for carrying the developer thereon, and formed with an opening in a part of a wall thereof for preventing pressure inside said developing chamber from rising excessively; and a filter for closing said opening of said developing chamber;

said cartridge comprising a shutter movable back and forth, when said cartridge is mounted on said developer supply section, between a first position where said shutter covers a developer outlet of said cartridge in a space substantially hermetically closed by said cartridge and a wall of said developer supply section, and a second position where said shutter is at least partly retracted from said space to uncover said developer outlet;

said device further comprising a passageway for providing communication between said space and said developing chamber.

10. A developing device for an image forming apparatus, comprising:

an accommodating section for accommodating a cartridge containing a developer, an inner periphery of said accommodating section and an outer periphery of said cartridge being so configured as to form a clearance therebetween which has a predetermined sectional area and extends in an intended direction of cartridge insertion;

a filter provided on at least a leading end portion, with respect to the intended direction of cartridge insertion, of the outer periphery of said cartridge for blocking said clearance; and a duct comprising a tunnel-like passageway having openings at opposite ends thereof which provide communication between a developing chamber and said accommodating section.

11. The developing device according to claim 10, wherein the opening of said duct at the end of said passageway corresponding to said developing chamber is at a level so that toner cannot enter into said duct.

12. A developing device for an image forming apparatus, comprising:

an accommodating section for accommodating a cartridge containing a developer, an inner periphery of said accommodating section and an outer periphery of said cartridge being so configured as to form a clearance therebetween which has a predetermined sectional area and extends in an intended direction of cartridge insertion; and a filter provided on at least a leading end portion, with respect to the intended direction of cartridge insertion, of the outer periphery of said cartridge for blocking said clearance, said filter being provided around the entire circumference of said cartridge.

* * * * *